United States Patent [19]

Jahier

[11] Patent Number: 4,516,534

[45] Date of Patent: May 14, 1985

[54] STEEL CONSTRUCTION SOLID-FUEL FIRING BOILER FOR CIVIL HEATING APPLICATIONS

[75] Inventor: Giovanni Jahier, Mantova, Italy

[73] Assignee: UNICAL S.p.A., Castel D'Ario, Italy

[21] Appl. No.: 619,569

[22] Filed: Jun. 11, 1984

[30] Foreign Application Priority Data

Mar. 16, 1984 [IT] Italy ..... 18107 A/84

[51] Int. Cl.[3] ..... F22B 5/00

[52] U.S. Cl. ..... 122/15; 110/234; 110/298; 126/361

[58] Field of Search ..... 122/15, 13 R; 126/361, 126/132; 237/8 R, 56; 110/234, 298

[56] References Cited

U.S. PATENT DOCUMENTS 4,461,242 7/1984 Black ..... 122/15

4,471,724 9/1984 Pope ..... 122/15 X

*Primary Examiner*—Edward G. Favors

*Attorney, Agent, or Firm*—Guido Modiano; Albert Josif

[57] ABSTRACT

A novel steel construction solid-fuel firing boiler for civil heating applications comprises a space portion defined by side, bottom, cover, front and rear walls forming therein an interspace for water to be heated, a firestone block burner in the space portion separating a fuel containing upper zone and a lower zone where a flame extends and flue gas is conveyed, the burner defining at a top face thereof a housing with a bottom hole for communicating the upper and lower zones and accommodating therein a refractory material body having a structure for holding overlying embers. The housing bottom and the refractory material body define a channel opening at the hole and communicating with an air distribution chamber in the front wall for conveying secondary combustion air. The boiler further comprises an electric fan with an automatic control circuit and primary and secondary combustion air outlet in communication with the upper zone and the distribution chamber, a smoke box, a loading door on the front wall, an inspection door and a communication port between the upper zone and the smoke box closed by a manually operated gate.

11 Claims, 7 Drawing Figures

STEEL CONSTRUCTION SOLID-FUEL FIRING BOILER FOR CIVIL HEATING APPLICATIONS

BACKGROUND OF THE INVENTION

As is known, heating system boilers firing solid fuels as wood, coal, and residual products are gaining a widespread acceptance and among these, one boiler wherein combustion takes place by natural draft and with a downwardly directed flame from a fuel supporting grate.

This last boiler type, while offering some definite advantages, also has some disadvantageous features, which are shared with some other boiler types, such as the impossibility of controlling, but in a coarse way, the combustion process with consequent poor performance, some starting difficulties, and the need for large section area chimneys.

SUMMARY OF THE INVENTION

It is an object of this invention to provide a steel construction solid-fuel firing boiler for civil heating applications, of the downwardly directed flame kind, wherein the combustion process can be controlled to adjust the heat generation according to the demand from the system which the boiler is to serve, and which can be easily started and operated even with small section area chimneys.

It is another object of the invention to provide a boiler, wherein the burner is prevented from undergoing undesired deformation, affords high combustion temperatures and an attendant improved performance, and wherefrom the parts which are most subjected to wear can be easily removed.

A further object of this invention is to provide a boiler over the inner walls whereof no marked deposition of tarry substances can take place in operation such as to hinder the transfer of heat from the flue gases to the water to be heated.

These objects and other objects are achieved by a steel construction solid-fuel firing boiler for civil heating applications, according to the invention, characterized in that it comprises a space portion of vertically elongate shape bounded by longitudinal side walls, a bottom and a cover having an interspace containing the water to be heated and comprising delivery and return connections, and a front and a rear walls defining therein, at least in part, a similar interspace, said space portion being subdivided into an upper fuel containing zone and a lower zone where the flame extends and flue gases are conveyed from a burner comprising a block of firestone laid substantially horizontally and being provided at the top face thereof with a housing which has its bottom formed at a substantially center location with a bore adapted to communicate said upper and lower zones of the boiler space portion, and is adapted to contain, resting on the bottom at the periphery of the bore, at least one body formed from a refractory material provided at the space portion directly overlying the bore with a means of holding the overlying ambers, the housing bottom and surface of said body adapted to rest on said bottom being configured to produce, on contacting, a channel opening at the bore and communicating with an air distribution chamber located on the frontal front of the boiler to convey secondary combustion air, said distribution chamber being fed from an electric fan linked to an automatic control circuit and provided with a primary combustion air outlet to the high portion of the upper zone of the boiler space portion; a smoke box having close to its top a connection to a chimney, located at the rear front and in communication with the lower zone of said space portion; a loading door on the frontal front at the upper zone of said space portion and an inspection door also on the frontal front at the lower zone of said space portion; a communication port between the upper zone of said space portion and the smoke box, located close to the top thereof, closeable by a manually operated gate.

BRIEF DESCRIPTION OF THE DRAWINGS

Further features and advantages will be more clearly understood from the description of preferred, but not exclusive, embodiments of the invention, shown by way of illustration and not of limitation in the accompanying drawings, where.

DESCRIPTION OF THE PREFERRED EMBODIMENTS

Figure 1:
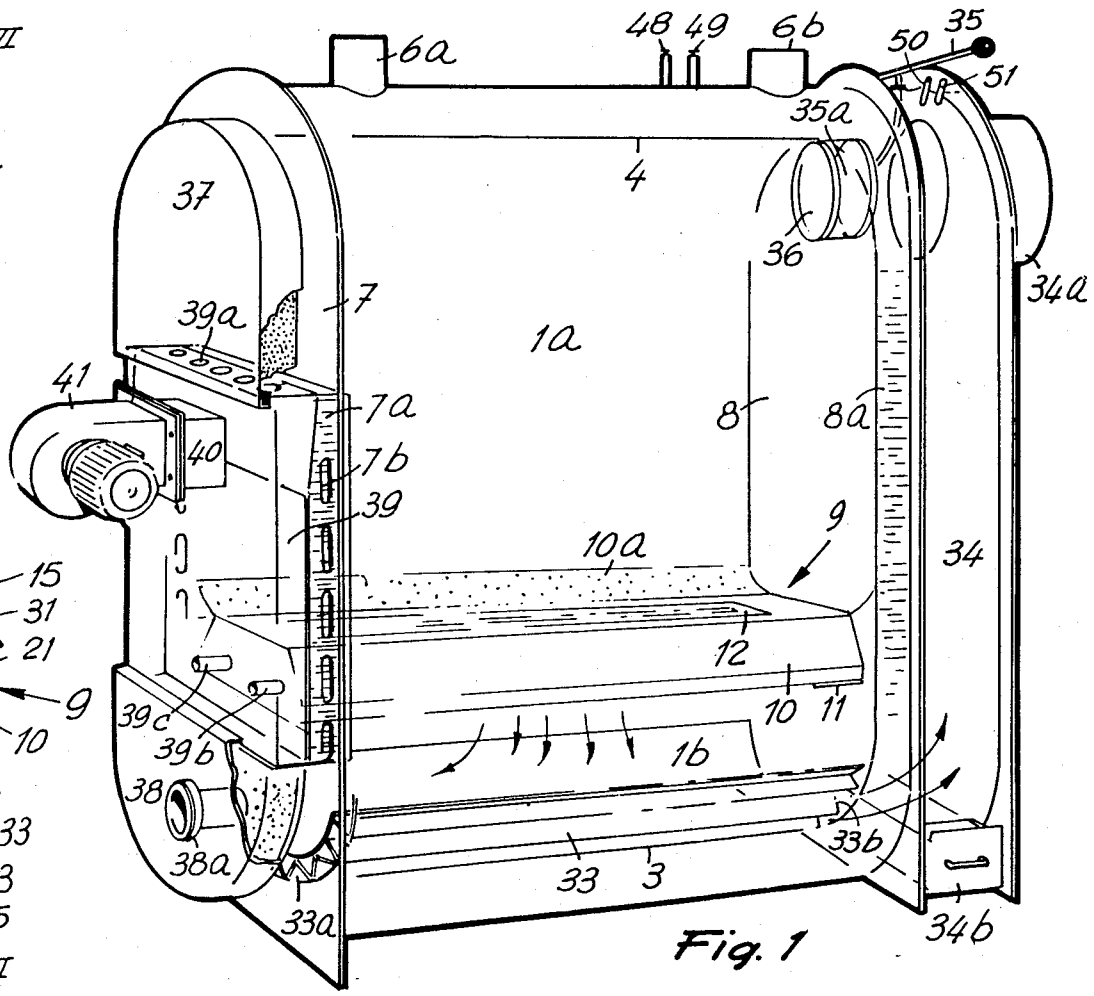
FIG. 1 is a perspective view of the invention, with some elements in ghost lines.

Making reference to FIGS. 1 to 5, indicated respectively at 1*a* and 1*b* are the upper zone and lower zone of the space portion bounded by the longitudinal side walls 2, bottom 3, and cover 4, all defining therein an interspace 5 containing the water to be heated and connected with delivery 6*a* and return 6*b* connections.

Furthermore the zones 1*a* and 1*b* are delimited by the front wall 7 and rear wall 8: the front wall 7 comprises the apparatus which will be described in detail hereinafter, additionally to the interspace band 7*a* containing the water to be heated and in communication with the interspace 5 through holes such as 7*b;* the front wall 8 defines therein an interspace 8*a* also containing water to be heated and in communication with the interspace 5.

Separation of the upper zone 1*a* intended to contain the fuel, which in the figures is represented by wood pieces but could indifferently comprise coal or any other solid fuel as well, from the lower zone 1*b* is obtained by means of the burner generally indicated at 9, which will be described in detail hereunder.

Said burner 9 comprises, therefore, a firestone block 10 carried on brackets 11, the space between the edges of the block 10 and the walls 2 being filled with a refractory material 10*a*. The block 10 has at the top face a housing 12 on the flat bottom whereof is an elongate hole 13 which places in communication the upper 1*a* and lower 1*b* zones of the boiler space portion.

Figure 3:
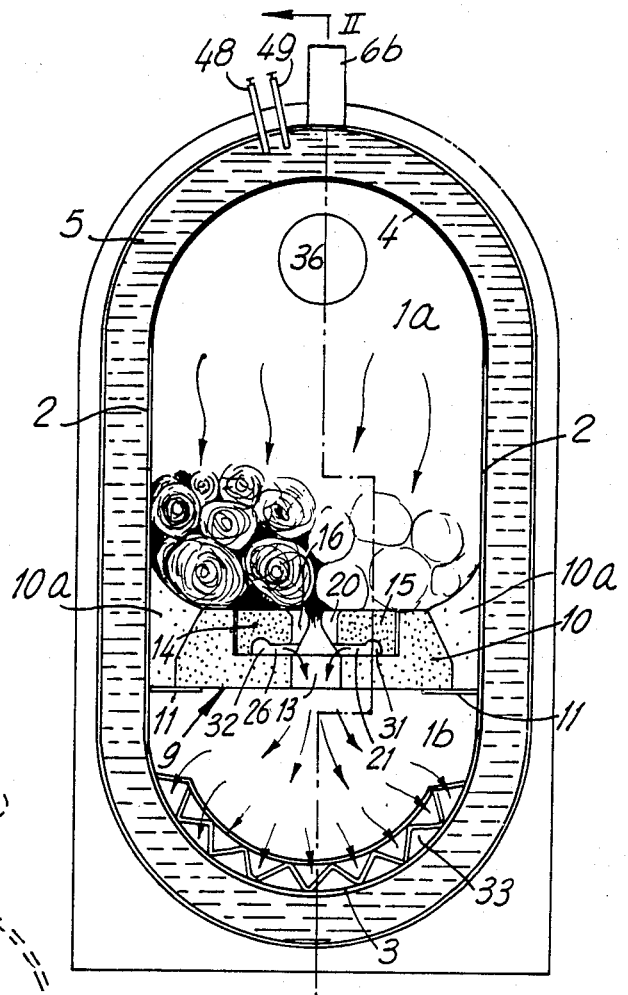
FIG. 3 shows a cross-section along the line III—III of FIG. 2.
Figure 4:
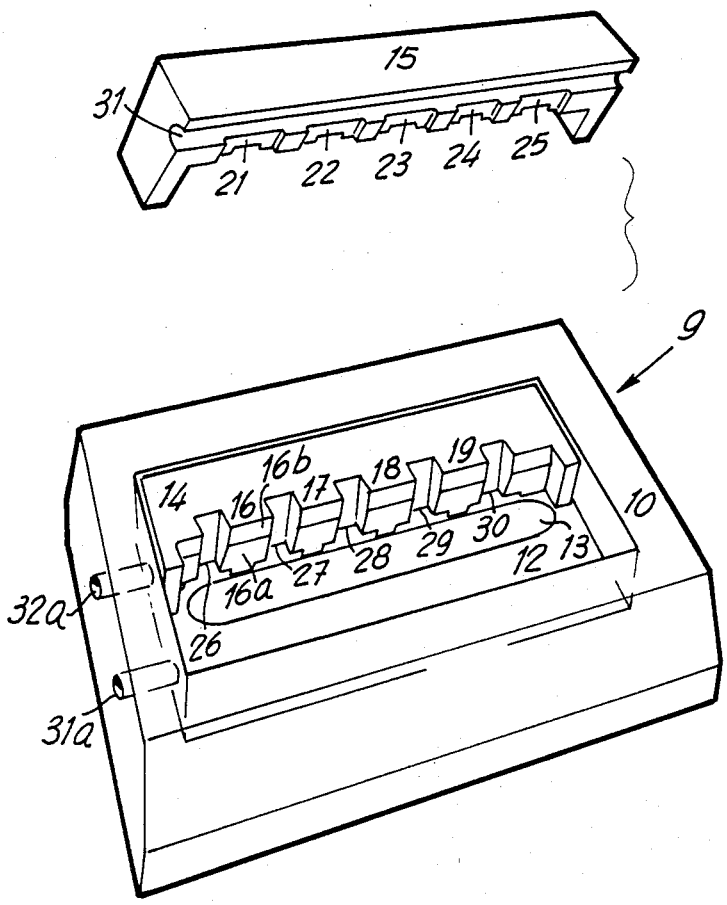
FIG. 4 is a partly exploded detail view of the burner according to a first embodiment.

Laid to rest on the bottom of the housing 12, at the edges of the hole 13, are the fire bars 14 and 15 formed from a refractory material which have on the face facing said hole 13 a plurality of facing teeth: in FIG. 4 those of the fire bar 14 are in full view, as indicated respectively at 16,17,18,19, and owing to the particular selection of the section plane III—III, the tooth indicated at 16 is visible also from FIG. 3 as viewed sideway; identical, and as mentioned, facing them, are the teeth on the fire bar 15 one of which, as viewed sideways, is shown in FIG. 3 and indicated at 20.

As brought out in the Figures, the teeth on the fire bars extend, without contacting one another, into the space portion located above the hole 13, so as to hold the embers present therein, with surfaces which, originating substantially from the edges of said hole, have a sloping lower portion such as 16*a* and a substantially vertical upper portion such as 16*b*.

Figure 2:
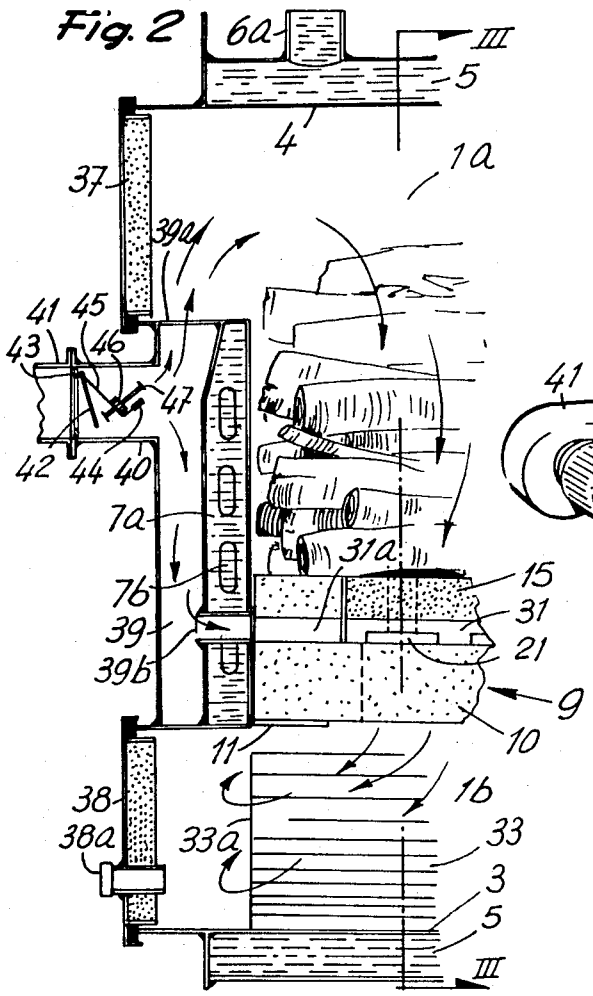
FIG. 2 is a sectional view of the invention taken along the line II—II of FIG. 3, at the frontside during steady state operation.

At the rest face on the bottom of the housing, the fire bars 14 and 15 have a series of crosswise recesses: clearly shown in FIG. 4 are those of the fire bar 15, respectively indicated at 21,22,23,24,25, and the recess 21 is also shown in FIGS. 2 and 3; in regard to the fire bar 14, shown in FIG. 4 are the outlets of the recesses 26,27,28,29,30, and the recess 26 is shown in full in FIG. 3.

The aforesaid recesses of the fire bar 15 are in communication with a longitudinal groove 31, and those of the fire bar 14 with an analogous groove 32, said grooves 31 and 32 are, respectively, in correspondence with holes 31*a*, 32*a* formed in the block 10 and facing conduits 39*b*, 39*c* which will be more fully described hereinafter.

The thermal exchange surface between the combustion products and water to be heated is increased at the lower zone 1*b* by anti-corrosion dry pipes 33 open at the end 33*a* at the front wall 7, and in communication at the other end 33*b* with a smoke box 34 having a fitting 34*a* for connection to the chimney and a chest 34*b* for collecting the ashes.

Figure 5:
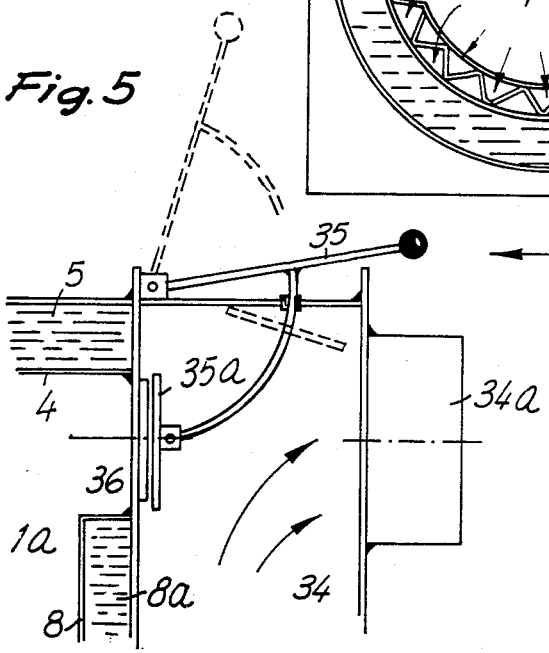
FIG. 5 shows a detail of the gate closing the port which puts the smoke box in communication with the space portion intended to contain the fuel; shown in full lines is the gate in the closed position, and in dash lines in the open position.

The faculty is also provided of placing into communication the smoke box 34 directly with the upper zone 1*a*, for the purpose of allowing some operative phases which will be described in discussing the operation, by moving, through manual operation of a rod 35, the gate 35*a* from the position of closure of the port 36, shown in full lines in FIGS. 1 and 5, to the open one shown in dash lines in FIG. 5.

Provided on the front wall 7 are the loading door 37 which opens into the zone 1*a*, inspection door 38 having a window 38*a*, at the zone 1*b*, and the combustion air distribution chamber 39 fed, through the fitting 40, from the electric fan 41, and provided with holes such as 39*a* letting out the primary air and arranged such that the flow of said air is directed toward the high portion of the upper zone 1*a*, and with the conduits 39*b*,39*c* for letting out the secondary air at the burner 9, as explained more clearly in connection with the operation.

Provided inside the fitting 40 is a flap valve 42 which is lifted by rotation about a pin 43 as the electric fan 41 is operated so as to overcome its own weight and the action of a weight 44 attached at the end of a rod 45 rigid with the valve 42 and pivoted at the pin 43 for the purpose of holding the valve 42 firmly in the shut off position with the electric fan inoperative; the contact of the rod 45 with the detent 46 fixed at an adjustable position along a shank 47 located close to the wall of the fitting 40 allows the realization of the opening travel limit stop for the valve 42.

The electric fan 41 is linked, as will be better explained in discussing the operation, to an automatic control circuit comprising the control 48 and safety 49 thermostats inserted into the interspace 5, and the maximum flue gas temperature 50 and minimum flue gas temperature 51 thermostats inserted at the top of the smoke box 34.

Figure 7:
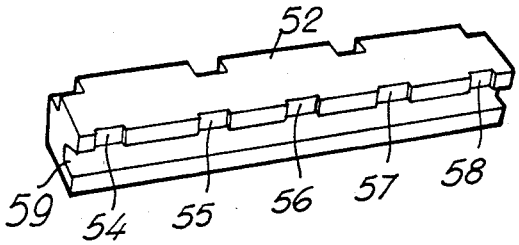
FIG. 7 shows a detail of a fire bar according to the embodiment of FIG. 6.
Figure 6:
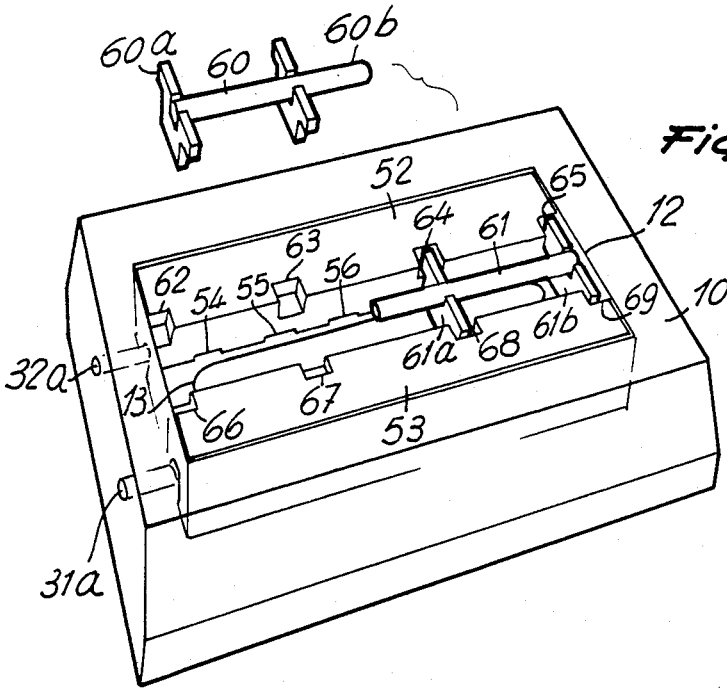
FIG. 6 shows a detail of the burner according to a second embodiment, in a partly exploded view.

With reference to FIGS. 6 and 7, a variation of the burner will be now described; this variation still comprises the firestone block 10 with a housing 12 having at the bottom the hole 13 adapted to put into communication the upper and lower zones of the space portion of the boiler. Resting on the edges of the hole 13 on the flat bottom of the housing are two fire bars 52 and 53 of a refractory material which have, similarly to what has been described for the fire bars 14 and 15, the surface intended to rest at the bottom formed with crosswise recesses such as 54,55,56,57,58 for the fire bar 52, in communication with longitudinal grooves such as 59 extending, in the mounted condition, in alignment with the holes 31*a*, 32*a* formed through the block 10 for access of the secondary air at the burner.

The fire bars 52 and 53 are provided with ember holding means overlying the hole 13 and comprising a metal grate formed by circular cross-section bars 60 and 61 having cross-pieces 60*a*, 60*b* and 61*a*, 61*b* for resting in corresponding cutouts 62, 63, 64, 65 of the fire bar 52 and facing cutouts 66, 67, 68, 69 of the fire bar 53. Therefore the bars 60 and 61 will extend parallel to the hole 13 of block 10.

The boiler according to the invention operates as follows.

With the boiler operating in a steady state, the doors 37 and 38 and gate 35*a* are closed and the electric fan in operation: a part of the air forced by the latter into the distribution chamber 39, constituting the primary combustion air, leaves through the holes 39*a*, and following the path indicated by the arrows in FIGS. 2 and 3, flows through the mass of fuel contained in the zone 1*a* and resting on the burner 9, meeting, from top to bottom, first the uppermost layers comprising firewood being dried, and then flowing down the firewood layers in the volatile substance distillation stage, and finally the coal layers in the zone adjacent the burner 9 where combustion proper takes place.

The products of the combustion between the solid and volatile combustible substances of firewood and the primary air, still laden with combustible substances, enter from above the space portion delimited by the refractory material fire bars and hole 13, where they combine with the secondary air, as advantageously preheated, which flows according to the arrows of FIG. 3 into this space portion from the distribution chamber 39 through the conduits 39*b*,39*c*, the holes 31*a*,32*a* facing them, and the canalization formed by the longitudinal grooves and cross-wise recesses present on the lower face of the fire bars and delimited by the bottom of the housing 12; thus a complete combustion is produced which, together with the possibility of forcing the flame temperature quite high thanks to the contribution from the refractory material which has been adopted for the construction of the burner, ensures optimum performance.

It should be noted that the burner according to this invention, additionally to affording the optimum combustion just described, is configured to present no dangerous deformations, and it is for this reason that, for example, the metal grate of the variation shown in FIG.

6 is made in several parts, and those parts thereof which are more likely to wear out, that is those in direct contact with the embers, have been formed with fire bars which can be replaced with a very simple operation.

The flow of the combustion products leaving the burner 9 enters the zone 1*b* to penetrate, following the path indicated by the arrows in FIG. 2 and FIG. 3, the ends 33*a* of the dry pipes 33 in order to travel through them actively exchanging heat with the water contained in the interspace 5, and come off them to reach the smoke box 34 and hence the chimney through the fitting 34*a*.

The combustion process just described is controlled, and this is one of the basic features of the invention, by the control circuit comprising the above-described thermostats, thereby it becomes possible to obtain, in a manner quite like that of oil firing boilers, the optimum steady state combustion.

Thus, the control thermostat 48 causes the electric fan 41 to be turned off, with attendant extinguishing of the flame in the burner and very slow continuation of the combustion, on reaching a preset temperature for the water to be heated, providing for restarting of the electric fan and consequent reactivation of the flame as the water temperature drops below a certain level.

By utilizing the direct proportionality of the flue gas temperature to the delivered power, the maximum flue gas temperature thermostat 50 then serves, again by acting on the electric fan 41, the very important function of holding the combustion regime constant as, for example, the type of firewood varies which is progressively fed into the process, preventing those heat peaks which would occur in a natural or uncontrolled process on account of sudden and simultaneous distillation of a large part of the volatile substances contained in the fuel; thus, it becomes possible to obtain a sufficiently slow process to ensure long life of the same, following adequate loading with fuel, even over the optimum period of twenty four hours for operation of the boiler by a family. The minimum flue gas temperature thermostat 51 then causes the electric fan 41 to be definitively turned off on exhausting the fuel in the boiler.

Another feature to be pointed out is that the presence of the electric fan enables the boiler operation to be unrelated to the natural draft changes resulting from changes in the weather conditions, because it is the electric fan itself which meters the input air.

With the boiler according to the invention the starting phase is also made specially easy; since the steady state operation contemplates the presence of an ember amount in contact with the burner 9, said amount is formed by operating the boiler for a certain period, e.g. a quarter of an hour, on natural upward draft; to this aim, the door 38 and gate 35*a* are opened, creating an air flow in the desired direction which can keep the combustion going irrespective of how it has been triggered. At the end of the time required to form the embers, the electric fan 41 is started and the door 38 and gate 35*a* are closed for steady state operation.

The gate 35*a* is operated to open even prior to opening the door 37 for loading the fuel, to avoid smoke puffs to the outside.

The operation just described enables the obtainment of an almost total absence of tarry deposits on the boiler walls, and a negligible amount of ashes; the construction of the boiler itself provides easy access for any occurrence.

The invention as disclosed is susceptible to many modifications and changes without departing from the purview of the inventive idea; thus, for example, the fire bars inserted into the burner housing may be replaced with a single piece body, or a series of modular elements, and the secondary air conveying channel system may be formed, at least in part, on the bottom of said housing; the automatic control circuit could comprise, in addition to the cited thermostats, other members, such as a programming clock, and a secondary air control throttle valve could also be provided. In practicing the invention, all the details may be replaced with other technically equivalent elements; further, the materials used, as well as the shapes and dimensions, may be any ones depending on requirements.

I claim:

1. A steel construction solid-fuel firing boiler for civil heating applications, comprising a space portion defined by longitudinal side walls, by a bottom and a cover having an interspace containing water to be heated and comprising delivery and return connections, and by a front wall and a rear wall defining therein, at least in part, a similar interspace, a burner comprising a block of firestone arranged in said space portion and separating said space portion into a fuel containing upper zone and a lower zone where flame extends and flue gases are conveyed from said burner, said burner defining at a top face thereof a housing having, at a bottom portion thereof, a hole communicating said upper and lower zones of the boiler space portion; at least one body of a refractory material accommodated in said housing and resting on said bottom portion thereof, said at least one body presenting at a position directly overlying the hole, a means of holding overlying embers, said housing bottom portion and a surface of said body resting on said bottom portion defining a channel opening at the hole and communicating with an air distribution chamber located on the front wall of the boiler to convey secondary combustion air; a combustion air feeding electric fan linked to an automatic control circuit and provided with a secondary combustion air outlet in communication with said distribution chamber and a primary combustion air outlet in communication with a high portion of the upper zone of the boiler space portion; a smoke box extending adjacent to the rear wall and in communication with the lower zone of said space portions, said smoke box having, at a top portion thereof, a connection for discharging smokes a loading door on the front wall at the upper zone of said space portion and an inspection door on the front wall at the lower zone of said space portion; a communication port between the upper zone of said space portion and the smoke box at top portions thereof; and a manually operated gate at said communication port.

2. A boiler according to claim 1, wherein the firestone block is configured substantially as a parallelepipedon and supported on brackets extending from said front and side walls of the boiler space portion.

3. A boiler according to claim 1, with a refractory material filler between the firestone block and at least the walls of the boiler space portion.

4. A boiler according to claim 1, wherein said housing accommodates two fire bars of a refractory material resting on said bottom portion at longitudinal edges of said hole, said means of holding overlying embers comprising teeth projecting integrally from said fire bars into a space portion directly overlying said hole and facing each other at a distance, said teeth extending substantially from said hole edges with a surface having a sloping lower portion and substantially vertical upper portion, each of said fire bars being further provided, at a face resting on the bottom of the housing, with through crosswise recesses communicated to a longitudinal groove connected to a respective hole formed sideways in the firestone block and communicating with the air distribution chamber for access of secondary air.

5. A boiler according to claim 1, wherein said housing in the firestone block accommodates two fire bars of refractory material resting on the bottom portion at longitudinal edges of said hole, said fire bars comprising cutouts formed at an edge of an upper surface of said bars facing said hole, said means of holding overlying embers comprising a metal grate adapted to rest in said cutouts of said fire bars, each of said fire bars being further provided, at a lower face resting on said bottom portion of the housing, with through crosswise recesses in communication with a longitudinal groove connected to a respective hole formed sideways in the firestone block and communicating with the air distribution chamber for access of secondary air.

6. A boiler according to claim 5, characterized in that the metal grate comprises a plurality of circular cross-section bars aligned at a longitudinal axis of said hole, each of said cross-section bar being provided with at least two cross-pieces resting in the fire bar cutouts.

7. A boiler according to claim 1, wherein said interspace containing water to be heated on the front wall extends adjacent to said air distribution chamber.

8. A boiler according to claim 1, with dry anti-corrosion pipes extending along said bottom of said boiler, said dry anti-corrosion pipes conveying combustion products toward the smoke box and increasing a thermal exchange with said water.

9. A boiler according to claim 1, comprising an automatic shut-off flap valve arranged at a delivery conduit of said electric fan, said flap valve being automatically shut-off with the electric fan inoperative.

10. A boiler according to claim 9, characterized in that said flap valve is provided with an adjustable opening travel stop comprising a rod rigid with the valve, said rod cooperating with a detent attachable at an adjustable position at a wall of said delivery conduit, said rod carrying at an end thereof a weight firmly holding the valve in a closed position with the electric fan stopped.

11. A boiler according to claim 1, characterized in that the automatic control circuit connected to the combustion air feeding electric fan comprises at least one control thermostat and one safety thermostat inserted in the interspace containing the water to be heated, a flue gas maximum temperature thermostat and a flue gas minimum temperature thermostat.

* * * * *